United States Patent [19]

Tilman

[11] 3,941,957

[45] Mar. 2, 1976

[54] HIGH CURRENT HIGH VOLTAGE SWITCH STRUCTURE WITH CONDUCTIVE PISTON

[76] Inventor: Ted N. Tilman, 3538 Telegraph Drive, San Jose, Calif. 32951

[22] Filed: May 9, 1974

[21] Appl. No.: 468,564

[52] U.S. Cl. ..... 200/82 R; 200/16 B; 200/252

[51] Int. Cl.[2] ..... H01H 35/38

[58] Field of Search ..... 200/16 R, 16 B, 16 D, 163, 200/153 S, 82 R, 252; 335/182, 183, 184

[56] References Cited

UNITED STATES PATENTS

| | | | |
|---|---|---|---|
| 2,762,881 | 9/1956 | Brockwell | 200/153 S |
| 3,011,041 | 11/1961 | Bakels | 200/252 |
| 3,178,533 | 4/1965 | Lory | 200/16 D |
| 3,474,198 | 10/1969 | Conrad | 200/16 B |

FOREIGN PATENTS OR APPLICATIONS

| | | | |
|---|---|---|---|
| 1,242,739 | 6/1967 | Germany | 200/82 R |
| 1,247,442 | 8/1967 | Germany | 200/82 R |
| 930,980 | 7/1963 | United Kingdom | 200/82 R |
| 155,211 | 7/1938 | Germany | 200/16 B |

*Primary Examiner*—Gerald P. Tolin
*Attorney, Agent, or Firm*—John J. Leavitt

[57] ABSTRACT

Presented is a switch structure having high current carrying capacity over a broad range of frequencies from DC to 50 megacycles, constructed to be air operated so as to eliminate the need for an external actuator. The switch includes an airactuated piston which reciprocates between open and closed positions of the switch, and which also constitutes the movable contact element of the switch.

23 Claims, 12 Drawing Figures

FIG. 1
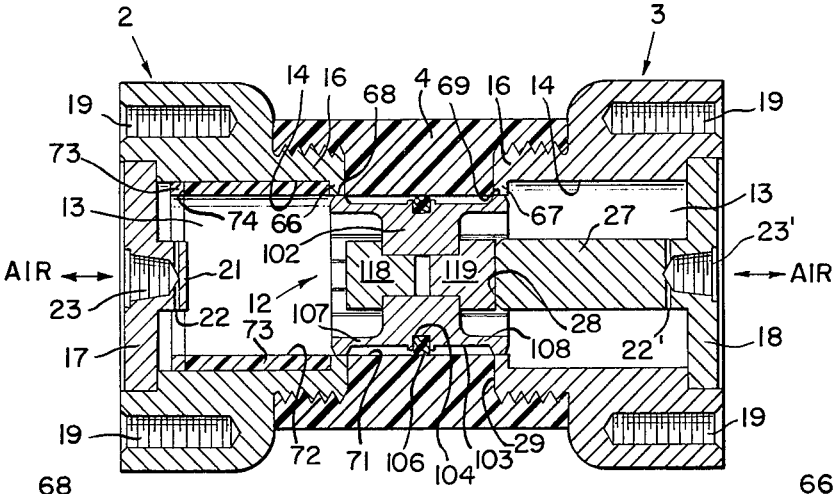
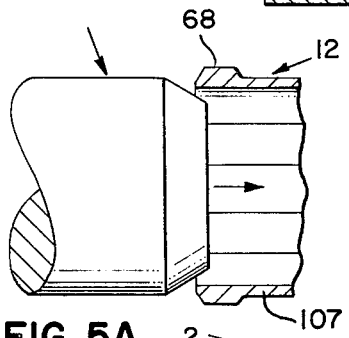
FIG. 5A
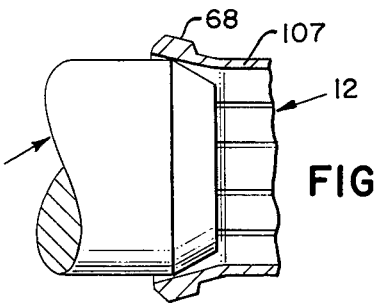
FIG. 5B
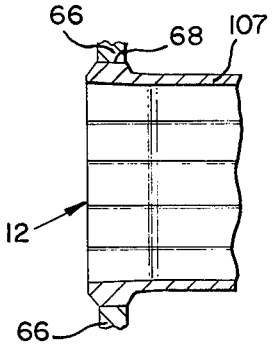
FIG. 5C
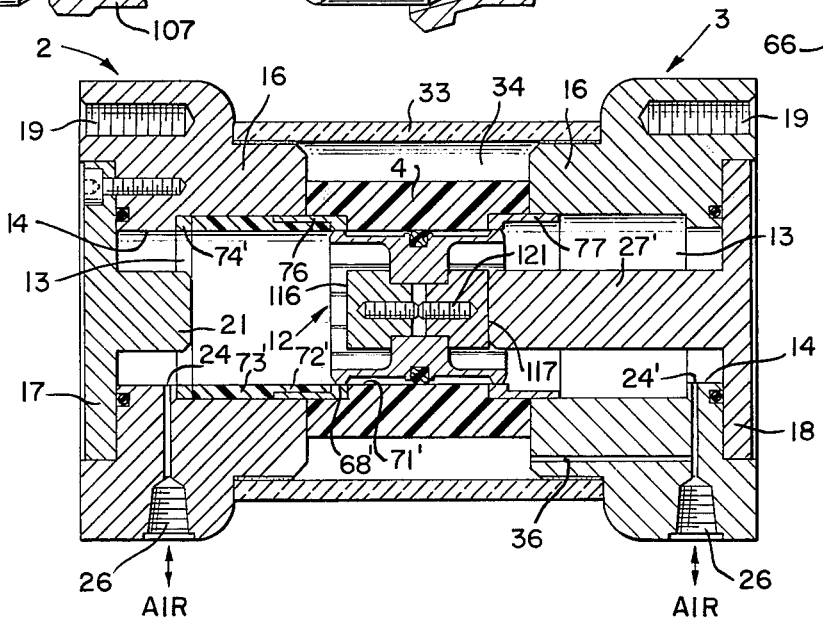
FIG. 2

HIGH CURRENT HIGH VOLTAGE SWITCH STRUCTURE WITH CONDUCTIVE PISTON

BACKGROUND OF THE INVENTION

The prior art is replete with switches of various designs. For instance, the inventor herein joined in the conception and design of the devices taught by U.S. Pat. No. 3,368,049 entitled High Current Radio Frequency Switch, and U.S. Pat. No. 3,394,324 entitled Coaxial Switch. Both of these radio frequency devices, and many conventional switches have incorporated a vacuum envelope within which the contacts make and break a circuit through the switch. The inventor herein has pioneered vacuum-type radio frequency switches and other switches such as exemplified by the above noted patents and U.S. Pat. No. 3,261,953. The disadvantage inherent in a vacuum switch is that the cost of processing the vacuum switch tends to be prohibitive.

Additionally, because the atmosphere within the sealed vacuum envelope constitutes a high vacuum, it is especially difficult to achieve movement of parts relative to one another within the vacuum envelope without a certain amount of galling. The reason for such galling is that the surfaces of the metallic parts within a vacuum switch are so clean and free from oxidation that two metal parts that come together tend to stick together and resist relative movement one to the other. On the other hand, heretofor, it has not been practicable within the state of the art to produce a radio frequency switch that has the voltage standoff characteristics required for wide applicability without using a vacuum envelope. Accordingly, it is one of the principal objects of this invention to provide a switch structure which dispenses with the vacuum envelope.

Another of the disadvantages of conventional vacuum switches is the fact that these switches require the use of an external actuator to effect transfer or movement of the contact within the envelope. The use of external actuators has run the gamut from hydraulic to air, to solenoids, and to mechanical linkages adapted to effect transfer of the movable contact within the envelope. All such external actuators have required the utilization of a deformable vacuum tight wall in the nature of a flexible bellow or diaphragm interposed between the movable contact and the actuating mechanism. Where a solenoid has been used, it has been necessary to provide a vacuum tight seal between the coil structure of the solenoid and the armature thereof on which, or in association with which, is mounted the movable contact within the vacuum envelope portion of the switch. The use of such vacuum tight sealing methods and materials has required the utilization of special skills and fabrication techniques which contribute to the prohibitive cost of such devices. Accordingly, it is another object of this invention to provide a switch structure in which the contact element reciprocates and makes and breaks contact within a fluid medium.

So far as is known, a radio frequency switch has not been patented or successfully used in which the contact element of the switch constitutes a piston mounted for displacement between a switch "open" and switch "closed" position by the imposition of fluid pressure applied directly to the piston contact structure within the envelope, and which is useable for high direct or alternating current applications including radio frequency. Accordingly, it is a still further object of this invention to provide a switch structure suitable for both DC and radio frequency applications in which movement of the contact element is controlled by the direct application of fluid pressure thereto.

One of the problems that has been inherent in conventional vacuum switches has been the low contact pressure in such devices with attendant high contact resistance. Such low contact pressure derives from the fact that in all such switches contact pressure is dependent upon the external actuator which effects movement of the contact within the vacuum envelope. We have found, and it is therefore an object of this invention, that contact pressure be augmented several orders of magnitude, and result in decreased contact resistance, through design and fabrication of the fixed and movable contacts so that the contacts themselves, regardless of the actuating means therefor, generate or are responsible for the contact pressure and attendant low contact resistance.

Conventional radio frequency switches, both vacuum and air dielectric types, have been plagued by two obvious deficiencies. First, it is extremely important in a radio frequency switch that the inductance of the switch be kept to a minimum. Conventional radio frequency vacuum dielectric switches utilizing a bellow in the circuit in the conventional manner are subject to high inductance due to long current paths and are therefore limited in their application. Secondly, in conventional radio frequency switches little or no consideration is given to the distribution of voltage across the envelope, with the result that non-uniformly distributed high electrostatic stresses are imposed on the envelope, resulting in non-uniform heating of the envelope with attendant rupture thereof and destruction of the switch. It is therefor another object of the invention to produce an air-operated radio frequency switch which eliminates these deficiencies.

Still another object of the invention is the provision of a radio frequency switch capable of carrying high current in the order of 0 to 6000 amperes and which incorporates a contact assembly capable of handling DC or radio frequency signals up to about 50 megacycles.

The susceptibility of radio frequency switches to arcing between relatively movable members is well known. This is particularly true in a switch which is utilized in high current applications. One of the factors that initiates such arcing in a switch is contact "bounce" upon closing of the switch at high closing velocities. Accordingly, it is another object of the present invention to provide in a high current radio frequency switch a contact assembly and method of actuation thereof which inherently produces a built in resilience and resistance to contact bounce, thus reducing the tendency of the contact to generate an arc.

Among the factors that determine the cirtcuit breaking characteristics of a radio frequency switch is the efficiency with which heat generated in the contact elements is dissipated. It is well known that permitting the contact elements to operate at elevated temperatures increases the electrical resistance and thus lowers the current carrying capacity of the switch. This problem has been partially solved in the art by fabricating the relatively movable contact member of material possessing a large mass, the thought being that such large mass functions as a heat sink. This solution however introduces a new problem, namely, an increase in the inertial forces when the switch contact of large mass is moved at high velocity from one position to another. Such high inertial forces contribute to contact bounce and to arcing between the contact surfaces. Accordingly, it is yet another object of the present invention to provide a contact assembly for a high current radio frequency switch in which the contact assembly includes a piston moveable between requisite positions by the direct imposition of air pressure thereon, which also serves to absorb and convey away a large proportion of the heat from the radio frequency contact, and which works in conjunction with a fixed resilient contact that provides a multiplicity of short current carrying paths between the movable and fixed contacts.

In conventional radio frequency switches, whether they utilize a vacuum or an air dielectric, it has been unknown to use a single switch structure for different modes of operation. For instance, a single pole-single throw switch structure is not ordinarily also used for single pole-double throw or for cross-point applications. Accordingly, it is another object of the present invention to provide aa radio frequency switch structure which may be fabricated in either a single pole-single throw configuration, a single pole-double throw configuration, or double pole-double throw or even a multiplicity of poles interconnected to form a cross-point configuration.

DESCRIPTION OF THE PRIOR ART

It is of course well known that air pressure, or in a broader sense fluid pressure, has been used to actuate switches of various types. For instance, U.S. Pat. No. 2,794,087 which names the inventor herein as inventor, relates to a coaxial switch in which the movable contact is enclosed within a vacuum envelope and is actuated from outside the vacuum envelope by high pressure air working within an appropriate cylinder having a piston therein connected through a deformable bellows to the movable contact. It should be noted however that in this construction, the high pressure air is not admitted directly into the envelope within which the movable contact is enclosed, nor does the movable contact itself form the piston as in the present application. There are therefore important mechanical and functional differences in the present structure. One of these distinctions lies in the fact that with respect to the structure taught by U.S. Pat. No. 2,794,087, the movable contact slams into the fixed contact with a considerable amount of inertia, requiring the interposition of a post arranged to absorb the energy of impact of the movable contact. By contrast, in the present invention, the movable contact slides along a slideway, with the movable contact coming into engagement with the fixed contact in a wiping action that wholly eliminates the mechanical shock of impact between movable contact and fixed contact, thus precluding the possibility of contact bounce.

Another vacuum switch structure which operates similar to U.S. Pat. No. 2,794,087 is taught by U.S. Pat. No. 2,917,596 in which the inventor herein is again named as inventor. As taught by this patent, air under pressure is admitted to an air cylinder disposed outside of the switch structure, the movable contact of the switch forming no part of the piston which actuates the movable contact, and electrical contact being effected by impact of one movable contact against a fixed contact.

Again, by way of comparison and distinction, in the present invention a circuit is completed between two terminals by sliding action of the movable contact from one position to another. Such movement of the movable contact does not involve an impact-generating abutment between the movable contact and the associated fixed contact, such contact being effected by a wiping action between the movable contact and the fixed contacts.

In U.S. Pat. No. 2,863,026, it is noted that a movable connector contact is provided which moves axially to make and break a circuit between two oppositely disposed contact terminals. It should be noted however that in that structure the connector contact is caused to move by abutment by the moving mobile contact, continued movement of the two contacts after abutment effecting movement of the connector contact into abutment with the fixed contact. Additionally, in that structure, contact between the various electrically conductive members is not effected with a wiping action.

There are switch structures of course that do incorporate movable contacts which wipe across an associated fixed contact. An example of such a construction is shown in U.S. Pat. No. 2,886,671 in which a triadic shoe is arranged to slide between associated pairs of contacts, being in permanent electrical contact with one of such contacts designated the feed contact or lead. In the present instance, in at least one aspect of the invention, the movable contact is shifted so that for a finite interval during its translation it does not contact any of the fixed contacts. In another aspect, the movable contact in the present invention is retained in resilient current carrying contact with one of the fixed contacts even during translation of the movable contact.

SUMMARY OF THE INVENTION

In terms of broad inclusion, the air actuated switch of the invention in one of its aspects comprises a hollow envelope formed from a pair of oppositely disposed axially aligned hollow metallic terminal members retained in spaced relationship by an intermediate dielectric envelope portion which also functions as a piston cylinder. Each of the terminals is provided with appropriate fixed contact members, and a piston is arranged within the envelope reciprocable to make or break a circuit through the fixed contact members associated with each terminal. The displacement of the piston is effected by the direct imposition against the piston of a suitable fluid pressure, such as compressed air, or other appropriate fluid, admitted to the interior of the envelope and piston cylinder through appropriate ports. In one aspect of the invention the only moving part in the switch is the reciprocable piston, which operates in a single pole-single throw mode. In another aspect of the invention, the fixed contacts within the envelope are arranged so that the single moving piston operates in a single pole-double throw mode, while in a third aspect of the invention a second piston is included within the hollow envelope so that the switch may be operated in almost a universal fashion to provide single pole-double throw operation, both switches open, both switches closed, make before break, break before make, single pole-single throw mode for bouble voltage, and single pole-single throw for double current. In a fourth aspect of the invention the terminal members are spaced apart and provided with axially aligned centrally disposed bores within which are fitted fixed resilient contacts that extend substantially 360° around the bores and which make contact with the movable contact through a multiplicity of short electrically conductive paths.

BRIEF DESCRIPTION OF THE DRAWINGS

FIG. 1 is a cross-sectional view through the central axis of the switch, the movable contact member being illustrated in a position to complete a circuit through the switch.

FIG. 2 is a cross-sectional view taken through the central axis of a second embodiment of the switch, the movable contact member again being illustrated in a position to complete a circuit through the switch.

FIG. 5A is a fragmentary sectional view partly in elevation illustrating the relationship of the movable contact fingers arranged in a cylindrical array and preparatory to being expanded by an appropriate tool.

FIG. 5B is a fragmentary sectional view similar to FIG. 5A, but showing the tool advanced to effect displacement of the contact fingers beyond their elastic limit so that the fingers remain in expanded position.

FIG. 5C is a fragmentary sectional view illustrating the relationship between fixed and movable contacts and between the movable contact and the adjacent dielectric sleeve which precludes the necessity of the movable contact fingers from flexing during translation from one position to another.

DESCRIPTION OF THE PREFERRED EMBODIMENTS

Figure 3:
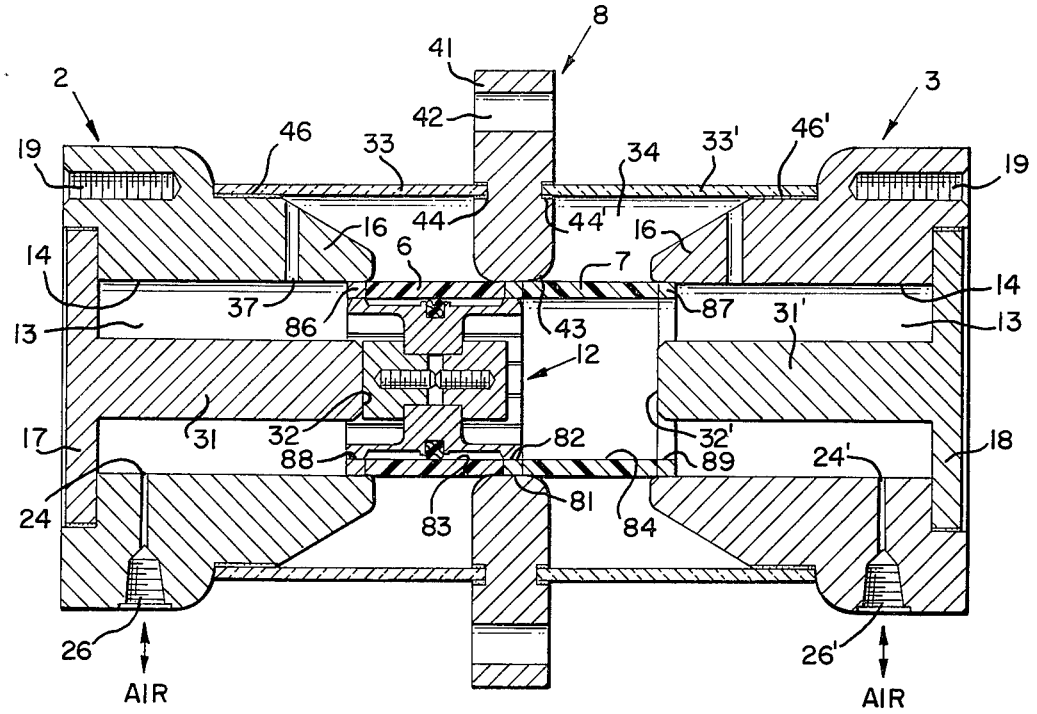
FIG. 3 is a cross-sectional view and illustrates a third embodiment of the switch of the invention, shown in a single pole-double throw configuration, the movable contact member of the switch being illustrated in a position to complete a circuit through a pair of the poles.

In terms of greater detail, the switch of the invention, in its various aspects as illustrated in the drawings above and as explained in greater detail herein, comprises a pair of electrically conductive metallic connection terminals designated generally by the numerals 2 and 3, the pair of connection terminals being axially aligned with respect to a central axis, and each being preferably configured symmetrically about the central axis and concentrically disposed thereabout. The connection terminals of each of the switch structures illustrated in FIGS. 1 and 2 are rigidly and electrically nonconductively interconnected by a dieelectric sleeve 4 in a manner which will hereinafter be explained in greater detail in respect to each of these embodiments. In the embodiments of the invention illustrated in FIGS. 3 and 4, the electrically conductive connection terminals of each switch are interconnected by a pair of dielectric sleeves 6 and 7, coaxially aligned with remote ends rigidly attached to the associated connection terminals, and their associated ends rigidly attached to an intermediate terminal member designated generally by the numeral 8 (FIG. 3) and an intermediate terminal member designated generally by the numeral 9 (FIG. 4) which will also be explained hereinafter in greater detail.

In each of the four embodiments of the switch structure illustrated in FIGS. 1 through 4, there is provided a movable contact assembly designated generally by the numeral 12 and adapted to be reciprocated longitudinally with respect to the switch structure so as to make or break a circuit between selected terminals. In each switch structure, the movable contact assembly is caused to move in one direction or other by air pressure admitted to the interior of the hollow envelope formed by the associated connection terminals and the intermediate dielectric sleeve or sleeves. In this respect, and in this mode of operation, the movable contact assembly constitutes a piston and the interior bore of the connection terminals and the interior bore of the associated intermediate sleeve or sleeves cooperate to define a cylinder within which the pitson-like movable contact assembly reciprocates under the impetus of fluid pressure admitted to the cylinder. It will be noted from a comparison of the different embodiments illustrated in FIGS. 1 through 4 that many of the components utilized in these switch structures are common in design and function, with changes being made only to accomplish a particular purpose of mode of operation. Accordingly, in the interest of brevity, corresponding parts in the different embodiments will be designated by corresponding reference numbers, and specific differences in structure, function, or mode of operation will be explained separately with respect to each of the different embodiments in FIGS. 1 through 4.

Referring to FIG. 1, it will be noted that each of the connection terminals 2 and 3 is generally cylindrical in configuration, and provided with a hollow interior 13 defined by the inner peripheral surface 14 which lies concentrically disposed about the central axis of each of the switch structures. It should also be noted that the cylindrical inner peripheral surfaces 14 of the connection terminals associated with each switch are in coextensive alignment.

Each of the connection terminals of each of the switches is also configured to provide in each switch mutually reaching reduced-in-diameter support portions 16, the support portions in each switch structure sealingly abutting or otherwise sealingly engaging the associated intermediate dielectric sleeve member 4 (FIGS. 1 and 2) or dielectric sleeves 6 and 7 (FIGS. 3 and 4), so that the cooperative effect of uniting the opposed connection terminals of each embodiment with the intermediate dielectric members is to form an air-tight elongated generally cylindrical hollow envelope concentric and symmetrical about a longitudinal central axis.

To close the envelope, opposite ends of the assembly are closed by end plates 17 and 18 closing the left and right ends, respectively. In each embodiment, the end plates extend transversely with respect to the central axis, with the peripheral edge of each end plate being nested in an appropriate rabbet formed in the inner peripheral surface 14 of each connection terminal. As will be seen in each of FIGS. 1 through 4, the outer surface of each end plate lies flush with the end surface of the connection terminal with which it is associated. This is an advantage because it facilitates connection of the switch structure to associated circuit members such as conductive straps or bus bars. For this purpose, each of the connection terminals may conveniently be provided with a plurality of threaded bores 19 as shown.

Referring to the end caps 17 in FIGS. 1, 2 and 3, it will be seen that interiorly of the switch envelope each end cap is provided with a concentrically disposed inwardly extending post or pad 21 which extends into the hollow interior 13 an amount depending upon the function to be performed by each post or pad in its associated environment. Thus, with respect to FIG. 1, the pad 21 is provided with a transversely extending bore 22 connected by an exteriorly extending threaded bore 23 so that the hollow within the envelope may be connected with an appropriate source of compressed air outside the envelope, thus providing interconnected passageways 22–23 through which high pressure air may be admitted to the hollow interior 13 of the envelope.

With respect to the embodiment illustrated in FIG. 2, the pad or post 21 is somewhat longer than the corresponding part in the FIG. 1 embodiment, and in this case the pad is not used as a means of providing admission of high pressure air to the hollow interior 13. To accomplish this purpose in the embodiment illustrated in FIG. 2, the connection terminal 2, is provided with the transversely extending passageway 24, the inner end of which communicates with the interior hollow 13 and the other end of which communicates with a threaded bore 26 formed in the connection terminal so that a high pressure air hose may be connected thereto. This latter construction is also utilized in the embodiments illustrated in FIGS. 3 and 4, and in the interest of brevity, corresponding reference numbers have been applied to corresponding parts.

In connection with end caps 18, and referring specifically to FIG. 1, it will be noted that end cap 18 is provided interiorly with an elongated post 27 having an inner end surface 28 and a transversely extending passageway 22' communicating with threaded bore 23'. In general, the end surface 28 of the post lies in planar alignment with the end surface 29 of the support section 16.

Referring to FIG. 2, it will be noted that this embodiment of the invention utilizes a post 27' of the same length as the post 27 in FIG. 1, but omits the transverse air passage 22' and threaded bore 23'. In this embodiment, air is admitted into the chamber 13 within connection terminal 3 through transverse passage 24' and threaded bore 26', similar to corresponding passageways formed in connection terminal 2 and discussed above.

Figure 4:
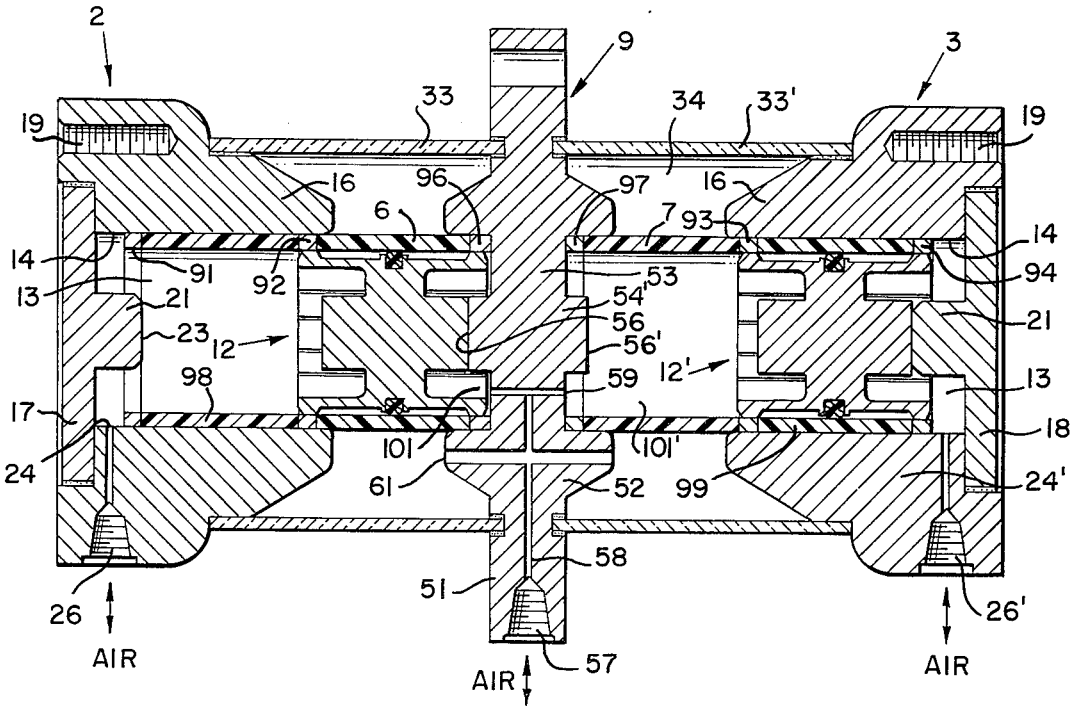
FIG. 4 is a cross-sectional view of a fourth embodiment of the switch of the invention, incorporating a pair of single pole-single throw switches in a single envelope, and incorporating a pair of movable contacts, each operable independently of the other or in cooperation with the other to provide a maximum of versatility in operation of the switch.

Referring to FIGS. 3 and 4, the end cap 17 in FIG. 3 is provided interiorly with an axially extending concentrically disposed post 31 having a length substantially similar to the length of the connection terminal 2, and providing an end surface 32 similar to the end surfaces 28 and 28' in FIGS. 1 and 2. In this embodiment, the end cap 18 is similarily formed with an axially disposed inwardly extending concentric post 31' having an inner end surface 32'. In FIG. 4, end cap 18 is provided with a pad 21' similar to the pad 21 formed on end cap 17 in FIG. 2. In both the embodiments illustrated in FIGS. 3 and 4, air under pressure is admitted to the interior chamber 13 within terminal connections 3 through passageways similar to those described in connection with the opposite terminal 2, ie.e., transversely extending passageways 24' and 26'.

In the embodiments illustrated in FIGS. 2, 3 and 4, it will be noted that the intermediate dielectric sleeves 4 and 6 are surrounded by an additional concentric cylindrical and dielectric sleeve 33. In each of these embodiments, the sleeve 33 creates an annular void 34 disposed between the concentric sleeves. These sleeves are preferably formed from a suitable epoxy glass, and are rigidly sealed between associated connection terminals 2 and 3 as shown, by an appropriate epoxy adhesive disposed between end portions of these and the associated connection terminal. In the embodiments illustrated in FIGS. 2 and 3, the annular space 34 disposed between the dielectric sleeves may be pressurized by admission of air under pressure through appropriate passageways 36 (FIG. 2) and 37 (FIG. 3) so as to increase the withstand voltage between opposing terminal connections 2 and 3. Alternatively, this space may be filled during manufacture with an appropriate dielectric jell or other appropriate fluid.

The embodiments illustrated in FIGS. 3 and 4 differ in that the envelope construction incorporates the intermediate terminal member designated generally by the numeral 9. In both these embodiments, the intermediate terminal member comprises a circular plate having an outer peripheral portion 41 which may be provided with mounting holes 42 for mounting the switch to an appropriate support panel (not shown). Alternatively, the mounting holes may be omitted and mounting of the switch effected through the threaded bores 19 provided in the terminal connections 2 and 3. With respect to FIG. 3, the intermediate terminal member 8 constitutes an annulus having an inner peripheral surface 43 to which associate ends of the axially aligned dielectric sleeves 6 and 7 are appropriately secured, as by the interposition of an appropriate adhesive. The body portion of the annular plate is provided with annular recesses 44 and 44' adapted to receive the associated ends of the dielectric sleeves 33 and 33' surrounding dielectric sleeves 6 and 7 respectively.

It will thus be seen that since the outer end portions 46 and 46' of sleeves 33 and 33' are rigidly secured to the associated terminals 2 and 3, and since the inner end portions of these same sleeves are rigidly attached to the intermediate member 8, and further since the dielectric sleeves 6 and 7 are rigidly interposed between the mounting portions 16 of terminal connections 2 and 3, and the intermediate terminal plate 8, the envelope so formed is rugged and capable of manufacture and assembly through assembly line techniques.

In the embodiment of the invention illustrated in FIG. 4, the circular intermediate terminal 9 is also platelike, having an outer peripheral portion 51 and intermediate portion 52 disposed between the associated ends of the dielectric cylinders 33–34 and 6–7 in both a transverse and longitudinal sense, and a central portion 53 provided with centrally disposed, coaxially entending pads 54 and 54' presenting transversely extending surfaces 56 and 56'. In this embodiment, the intermediate terminal member 9 is also provided with a transversely (radially) extending threaded bore 57 communicating with an extension thereof in the form of a transverse passageway 58 communicating at its inner end within the envelope with a longitudinally (axially) extending passageway 59 extending through the central body portion 53 of the intermediate terminal member 9.

The intermediate portion 52 of the terminal plate 9 is also provided with a longitudinally axially extending passageway 61 which communicates the passgeway 58 with the annular space 34 disposed between the coaxially arranged dielectric cylinders 33–33' and 6–7. In this embodiment, admission of high pressure air through the passageway 58 will result in the annular chamber 34 also being charged with the same high pressure air, and will result also in admission of such high pressure air into the chamber 13 disposed between the central body portion 53 of the intermediate terminal member and the terminal connections 2 and 3. From an electrical point of view, it will be noted that the terminal connections 2 and 3 are preferably fabricated from a high grade aluminum alloy for maximum electrical and thermal conductivity.

In the embodiment illustrated in FIG. 1, the mounting portions 16 of the terminal connections 2 and 3 are provided with fixed radially inwardly extending annular electrical contacts 66 and 67, respectively. The contacts 66 and 67 are provided with cylindrical contact surfaces 68 and 69, respectively, the contact surfaces 68 and 69 being axially spaced apart as shown, and the contacts are conveniently intergal with each associated terminals 2 and 3. The contact surfaces 68 and 69 lie flush with the inner cylindrical periphery 71 of the intermediate dielectric sleeve 4, and the inner peripheral cylindrical surface 72 of the sleeve 73 disposed in the form of a liner within the inner periphery 14 of terminal member 2. It will thus be seen that the contact 66 lies disposed between the sleeve 73 of the left and the sleeve 4 on the right, the surfaces 71 and 72 being, in effect, extensions of the contact surface 68. At the end of sleeve 73 remote from contact 68, there is provided a second radially inwardly extending conductive contact ring 73, the inner peripheral contact surface 74 of which lies flush with the inner peripheral surface 72 of the associated sleeve 73. It will thus be seen that the contact surfaces 68 and 74 and the inner peripheral surfaces of dielectric sleeves 73 and 4 form a continuous cylindrical surface which extends between the contact surface 69 of contact 67 and contact surface 74 of contact ring 73.

In the embodiment of the invention illustrated in FIG. 1, the movable contact designated generally by the numeral 12 is arranged to reciprocate within the cylindrical slideway formed by the inner peripheral surfaces discussed above, which also function as an air cylinder and a piston cylinder. In the position of the movable contact illustrated in FIG. 1, electrical energy is conducted by the movable contact between the terminal members 2 and 3. When air under pressure is admitted to the chamber 13 disposed within terminal member 3 through threaded bore 23' and transverse passageway 22', the movable contact 12 is caused to move to the left as viewed in FIG. 1, until it comes to rest on contact surfaces 68 and 74. In this respect, movement of the movable contact 12 to the left is limited by pad 21, and when moved to the right as viewed in FIG. 1 by admission of high pressure air into the chamber 13 disposed within the terminal member 2, movement of the movable contact 12 is limited by post 27 so that the movable contact comes to rest in the position indicated in FIG. 1. The specific construction of the movable contact 12 will be explained in greater detail hereinafter. It is important to note that in moving from one position to another the movable contact member makes and breaks electrical contact with the fixed contacts by a wiping action rather than through impact as in most conventional switches.

Referring to FIG. 2, in this embodiment, contacts 68' and 69' function in the same manner as the corresponding contacts in FIG. 1, but in this embodiment constitute radially inwardly projecting cylindrical ring portions formed on conductive contact sleeves 76 and 77. The end of each of the contact sleeves 76 and 77 remote from contacts 68' and 69' is suitably brazed to the inner peripheral surface 14 of the associated mounting portion 16 of the associated connection terminal members 2 and 3 as shown. In this embodiment, the inner peripheral surface 71' of the dielectric member 4 functions as a slideway, air cylinder and piston cylinder in the same manner as the corresponding surface in FIG. 1. Similarly dielectric sleeve 73' is provided with an inner peripheral surface 72' defined at one end by the contact surface 68' and at the other end by the contact surface 74' formed on contact ring 73'.

Again, as in FIG. 1 admission of high pressure air to the chamber 13 of connection terminal member 3 as viewed in FIG. 2 will cause the movable contact 12 to move to the left as to interrupt the electrically conductive path formed by the movable contact between the contacts 66' and 67'. The movable contact, under the impetus of such high pressure air, will come to rest against the pad 21, so that the movable contact will span the space between contact rings 66 and 73', both conductively related to connection terminal 2 and thus resting in a nonconductive attitude. Movement of the movable contact in the opposite direction, i.e., to the right as viewed in FIG. 2 from its non-conductive position of rest is effected by admitting high pressure air into the chamber 13 disposed within connection terminal member 2. It will of course be understood that with respect to each embodiment admission of air under pressure to the chamber 13 within one connection terminal member is accompanied by relief of the pressure within the chamber 13 in the opposite connection terminal member.

Referring to FIG. 3, the switch forming the subject matter of this embodiment constituting a single pole-double throw switch structure has the novel characteristic of being bi-stable. In this embodiment of the invention, the connection terminal members 2 and 3 are related to the intermediate terminal member 8, which can be said to be common in both the associated connection terminal members 2 and 3. Thus, there is provided on the inner peripheral surface 43 of the intermediate terminal member 8 an annular contact 81 having a cylindrical contact surface 82. The contact surface 82 is of the same diameter as the associated inner peripheral surfaces 83 and 84 of intermediate dielectric sleeves 6 and 7, respectively. Opposite ends of the dielectric sleeves 6 and 7 abut contact rings 86 and 87, respectively, each of these contact rings having inner peripheral surfaces 88 and 89, respectively, of the same diameter as the associated inner peripheral surfaces 83 and 84 of dielectric sleeves 6 and 7.

It will thus be seen that as the movable contact 12 reciprocates between the position illustrated in FIG. 3, and its alternate position spanning the space between intermediate contact 81 and end terminal contact 87, the inner peripheral surfaces of the members described above form a continuous smooth slideway for guiding movement of the movable contact 12. Additionally, these surfaces function as an air cylinder and piston cylinder, and the movable contact functions as a piston during the reciprocation within the piston cylinder. It will also be noted that movement of the movable contact 12 to the right as viewed in FIG. 3, is limited by the end surface 32' of post 31' while movement of the movable contact 12 to the left is limited by end surface 32 of post 31.

As with the embodiments illustrated in FIGS. 1 and 2, movement of the movable contact 12 is effected by admission of high pressure air into the chambers 13 formed in connection terminal members 2 and 3. Thus, admission of high pressure air into the chamber 13 associated with connection terminal member 2 as viewed in FIG. 3, will effect movement of the movable contact 12 to the right into its alternate position against stop surface 32'. In such alternate position, an electrical circuit will be completed between the intermediate terminal member 8 and connection terminal member 3.

Conversely, admitting air under pressure to the chamber 13 within terminal connection member 3, will cause the movable contact 12 to move from such alternate position to the left until it assumes the position illustrated in this figure. As there shown, the movable contact forms a continuous conductive path between the intermediate terminal member 8 and connection terminal member 2. It is important to note that the movable contact is fabricated so that it is approximately the same diameter as the associated conductive terminal members 2 and 3, or contact 81, an important consideration when the switch is used with higher frequencies. This fact is also important with respect to the substantially matching impedance of the movable contact as compared to the impedance of associated conductive surfaces.

The embodiment of the invention illustrated in FIG. 4 is similar in many ways to the embodiment of the invention illustrated in FIG. 3. In this embodiment, a second movable contact member 12' is provided, thus permitting greater flexibility in application of the switch in that within a single envelope, or embodied within a single structure, there is provided a pair of single pole-single throw switches each of which may be operated independent of the other, or which may be operated in unison to provide a single pole-double throw operation, simultaneous open or closed conditions, make before break or break before make operation, or single pole-single throw for double voltage and single pole-single throw for double current applications.

To achieve this versatility in a single structure, there is mounted on each of the two connection terminal members 2 and 3, and on the intermediate terminal member 9, pairs of contact rings 91–92, 93–94, and 96–97, respectively. As with the corresponding contact rings in the other embodiments illustrated in FIGS. 1 through 3, the cylindrical inner peripheral surfaces of these contact rings constitute contact surfaces coextensive with the cylindrical inner peripheral surfaces of the associated cylindrical sleeves 6 and 7, and dielectric sleeves 98 and 99 associated, respectively, with terminal connection members 2 and 3. As shown, the dielectric sleeve 98 lies within the inner periphery 14 of connection terminal member 2, bounded at one end by contact ring 91 and at the other end by contact ring 92.

In like manner, the dielectric sleeve 99 lies within the inner periphery 14 of terminal connection member 3, bounded on one end by contact ring 93 and at its other end by contact ring 94. It will thus be seen that with respect to the assembly on the left side of the intermediate terminal member 9, contacts 91, 92 and 96 and the inner peripheral surfaces thereof cooperate with dielectric sleeves 6 and 98 to provide a continuous and smooth slideway for reciprocal movement of the movable contact 12. In the position of the movable contact 12 illustrated in FIG. 4, an electrical circuit is completed between the connection terminal member 2 and the intermediate terminal member 9. When the movable contact 12 is moved to the left as viewed in FIG. 4, this electrical circuit is broken and the movable contact member 12 comes to rest in an electrical "off" position spanning the space between contacts 91 and 92. Movement in this direction is limited by pad 21. Movement of the movable contact 12 to the left as viewed in FIG. 4 is effected by admitting air under pressure through passageway 58 and connecting passageway 59 so that air under pressure is admitted to the chamber 101 disposed between the intermediate terminal member 9 and the associated end of the movable contact member 12.

With respect to the assembly illustrated to the right of the intermediate terminal member 9 in FIG. 4, the movable contact member 12' is there shown in its electrical off position, the movable contact member spanning the space between contacts 93 and 94. Again, as with the counterpart assembly on the left side of the intermediate terminal member 9, the inner periperal surfaces of contacts 93, 94 and 97, and the inner peripheral surfaces of dielectric sleeves 7 and 99 form a smooth slideway through which the movable contact 12' reciprocates. Movement of the movable contact 12' to the left as viewed in FIG. 4 is effected by admitting air under pressure to the chamber 13 through the transversely extending passageway 24' formed in connection terminal member 3. When the movable contact member 12' has reached its alternate position so as to complete a circuit between contact 93 on connection terminal member 3 and contact ring 97 on intermediate terminal member 9, it may be returned to its first position (illustrated in full lines in FIG. 4) by admitting air under pressure through passagway 58 and interconnecting passageway 59 into chamber 101', disposed between the intermediate terminal member and movable contact 12'.

It should be noted that with respect to this embodiment, movement of the movable contact members 12 and 12' may be controlled in several different modes. For instance, in the positions of the movable contacts illustrated, an electrical circuit is completed between connection terminal member 2 and intermediate terminal 9. There is no electrical connection between connection terminal 3 and intermediate terminal 9 in the position of movable contact 12' as illustrated. Admission of air however to chamber 13 in connection terminal member 3 will cause movable contact 12' move to the left, thus completing a second path for voltage and current between connection terminal member 3 and intermediate terminal member 9.

In another mode, the air pressures admitted to the various chambers 13, 101 and 101', may be controlled so that the two movable contacts 12 and 12' move in unison from left to right. Alternatively, air under pressure may be admitted to the passageways and chambers in such a way that the movable contacts simultaneously complete circuits between the intermediate terminal member 9 and the associated connection terminal members 2 and 3.

The movable contact member 12 as illustrated in FIGS. 1–4 and the movable contact member 12' as illustrated in FIG. 4, is designated and conditioned to cooperate with the various contact surfaces so as to minimize the contact resistance and thus minimize the current flow through the movable contact member. Additionally, the movable contact member while being designed for optimum electrical characteristics, is also designed to perform the mechanical function of a piston in combination with the associated cylindrical slideway surfaces or piston cylinder within which the movable contact member reciprocates. Additionally, it is important that the mass of the movable contact 12 be minimal, or at least within a predetermined range, so that the air pressure required to move the movable contact is minimized. In this respect, it is noted that a low mass minimizes the inertia required to be overcome to move the movable contact, thus enhancing speed of operation of the switch.

To achieve these important purposes, the movable contact in each of the embodiments includes a central body portion 102 the outer peripheral surface 103 of which is provided with an annular groove 104 within which is seated a suitable seal ring 106. The seal ring may be in the form of and O ring or it may be a quad ring. In each embodiment, the seal ring functions to seal the union between the movable contact member and the associated cylindrical slideway surfaces formed by the fixed contacts and the intermediate dielectric sleeves. The movable contact member thus forms a piston within the cylindrical slideway, being effectively, moved in one direction or the other by the admission of high pressure air into the chambers on opposite sides of the central body portion 102 of each movable contact member.

On opposite sides of the central body portion 102, and extending coaxially in opposite directions, are conductive metallic skirt portions 107 and 108. Each of the skirt portions is cylindrical in configuration, and is provided with a multiplicity of longitudinally extending slots 109 which convert each skirt portion into a multiplicity of parallel inherently resilient fingers 112. Each of the inherently resilient fingers 112 is provided on its extreme end with a contact surface 113 configured to conform to the cylindrical configuration of the associated inner peripheral surfaces of fixed contacts and intermediate dielectric sleeves. In this manner, a maximum amount of surface-to-surface contact is provided between each of the movable contact finger surfaces 113 and the fixed cylindrical contact surfaces against which they resiliently impinge.

Referring to FIG. 5, it will there be seen that after the slots 109 have been formed in the skirt portions of the movable contact, the resilient finger portions thus formed are sprung outwardly beyond their elastic limit so that they take a permanent set in which collectively the finger portions diverge outwardly in a conical array. Thus, when the movable contact is inserted into the cylindrical slideway provided by the inner peripheries of the fixed contacts and intermediate dielectric sleeves, the splayed resilient fingers are resiliently compressed into a smaller diameter skirt so as to be accommodated within the inner periphery of the slideway. Such compression of the resilient fingers into a smaller diameter skirt has the effect of resiliently loading the spring fingers so that after insertion they exert a strong resilient radially outwardly directed force against the fixed contact surfaces and the associated dielectric sleeves. A method of construction of the movable contact fingers is illustrated by way of example of FIG. 5. It will be apparent from this construction and mode of operation that after assembly and during operation of the switch, no flexure of the fingers occurs so that no "fatigue" is experienced by the fingers, thus contributing to the long life experience of the switch. The slotted contact configuration also results in a significant reduction of self-induced eddy currents at radio frequencies, thus precluding destructive heating of the movable contact.

Each of the movable contacts is also provided with a centrally disposed post or pad having a smaller diameter than the surrounding skirt portion of the movable contact and projecting axially on opposite sides of the central body portion of each movable contact to provide transversely extending end surfaces 116 and 117 which cooperate with the end surfaces of pads 21 and posts 27 to limit movement of the movable contact in each direction. Thus, referring to FIG. 1, the surface 117 is shown in contiguous abutment against the surface 28 of post 27. In this position of the parts, the resilient fingers arranged in a circular array to form the skirt portion of each of the movable contacts lie in direct opposition and resilient current carrying contact with fixed contact rings 66 and 67 as shown. Additionally, to enhance the current carrying capacity of the movable contact, it is important that heat generated in the movable contact be drawn therefrom. For this purpose, the posts 27, 27', 31, 54 and 54' function as heat sinks to draw heat from the movable contact.

Upon the admission of high pressure air into the chamber 13 through the passageway 22'–23', the movable contact will be caused to move to the left until the stop surface 116 comes into contact with the end surface of pad 21. In this position, the movable contact surfaces on the skirt 107 formed on the left end of the movable contact will be in resilient engagement with fixed contact ring 73. In like manner, the resilient contact finger surfaces on skirt 108 will have been shifted so that they now resiliently engage fixed contact ring 66. The same mode of operation is implicit in each of the other embodiments illustrated in FIGS. 2, 3 and 4.

It should be noted that there is little frictional resistance to movement of the movable contact from one position to another by virtue of the fact that for a major portion of its travel the resilient contact fingers press outwardly against the inner peripheral surface of the dielectric sleeves disposed between the fixed contact rings. To minimize frictional resistance, it is preferable that these cylindrical sleeves be fabricated from an appropriate grade of "Teflon". The fact that the inner peripheral surfaces of these "Teflon" sleeves is coextensive with the inner peripheral surfaces of the fixed contacts eliminates any impediment that might be imposed upon movement of the movable contact from one position to the other in that it eliminates any abutment uneveness or sudden impositions of stresses on the resilient contact fingers.

In connection with the illustration of the movable contact members 12 and 12', it will be noted that in FIG. 1, the centrally disposed post terminating at each end in stop surfaces 116 and 117 is formed in two parts of FIGS. 1 and 2, and as a single integral unit in FIG. 4. The construction illustrated in FIG. 1 embodies two posts 118 and 119 suitably seated in a central aperture formed in the body portion 102 of the movable contact and secured therein through appropriate braze techniques. In the embodiment of FIG. 2, a similar construction is used, however here a screw 121 has been added to one of the parts and a threaded bore has been provided in the other so as to permit mounting of the post portions 118 and 119 so as to properly position the surfaces 116 and 117.

It has been found however that by controlling manufacturing tolerances the spacing between the fixed contacts 66 and 67 may be made to closely correspond to the spacing between the contact surfaces formed on the resilient fingers constituting skirt portions 107 and 108, thus eliminating the necessity of the screw 121. Where used, the screw is adjusted to provide the requisite positioning of the stop surfaces 116 and 117 in relation to the stop surfaces formed on the pad 21 and post 27 (FIG. 1) and post portions 118 and 119 are then appropriately brazed to the central body portion 102 of the movable contact so that they retain their adjusted position.

In the embodiment of the invention illustrated in FIGS. 6 through 10, inclusive, the switch structure includes an end cap 126, preferably fabricated from aluminum and silver plated over its entire surface. For purposes of mounting the terminal to an associated structure, the end cap is provided with three mounting holes 127 spaced at 120° about the terminal member. Spaced from its end surface 128, the terminal is provided with a shoulder 129 which leads into an annular recess 131. From the shoulder 129, the terminal member is provided with a nose section 132 having a conically tapered face 133 which merges smoothly into an annular surface 134 lying transverse to the longitudinal axis 136 of the switch. The terminal member 126 is provided with a recess 137 having a bottom surface 138 and a cylindrical surface 139. The bottom surface 138 is provided with an annular cylindrical wall portion 141 proportioned to snugly receive in a press fit manner an electrically insulated and thermally conductive stop ring 142. The stop ring is preferably aluminum formed with a thick anodized coating thereon to provide the necessary electrical insulation.

The opposite end terminal member 143 is also cylindrical in general configuration, and is provided with three mounting bores 144 spaced at 120° intervals about the end terminal. A shoulder 129' is formed on a forward portion of the terminal, a shoulder merging smoothly with an annular recess 131' for purposes which will hereafter be explained. The soulder 129' merges integrally into a long nose section 132' which intercepts a transversely extending annular end face 134'. It will be noted from FIG. 6, that the end surfaces 134 and 134' of end terminal members 126 and 143 lie opposite each other and spaced apart approximately 1 inch in the embodiment illustrated, which is shown approximately full size.

The end terminal 143 in other respects differs from the end terminal member 126 in that the terminal member 143 is provided with a central bore 146 that extends from the end face 134' to adjacent the opposite end face 147. The end face 147 is recessed to provide a shoulder 148 within which is disposed an end cap 149 as shown. The end cap 149 may be conveniently secured permanently to the end terminal member 143 by application of an appropriate epoxy adhesive in the joint between the end cap 147 and the surrounding terminal member 143. For reasons which will hereinafter be explained, the bore 146 is further increased in diameter at 151 to provide an annular space between the inside surface 152 of the end plate 149 and the end of the bore 146.

Figure 8:
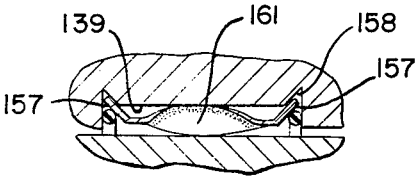
FIG. 8 is an enlarged fragmentary sectional view illustrating the method and means of retaining the fixed contact bands.
Figure 9:
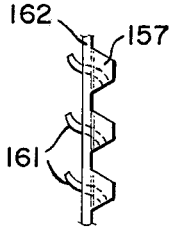
FIG. 9 is a fragmentary elevational edge view of the fixed contact band of FIG. 6.
Figure 10:
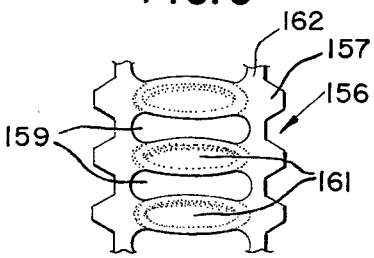
FIG. 10 is a fragmentary elevational plan view of the fixed contact band of FIG. 6.

Mounted on the nose section 132 and 132' of the end terminal members are fixed contact assemblies designated generally by the numerals 153 and 154. As indicated in FIGS. 8, 9 and 10, the fixed contacts 153 and 154 comprise elongated strips of electrically conductive material formed with serrations 156 along each opposite long edge thereof, the serrations constituting tabs 157 which may be bent as illustrated in FIG. 8 to nest within a recess 158 formed in the inner periphery of the bores 139 and 146. Between the serrations 156 on opposite long edges of the stip, the body of the strip is provided with a plurality of closely adjacent apertures 159 separated by a web 161 disposed between pairs of adjacent apertures. The webs 161 as illustrated in FIG. 9 are angularly disposed with respect to the plane of the edge strips 162 which separate the serrations 157 from the central body portion of the strip. Thus, the thin strip portion 162 separating the tabs 157 from the webs 161 lies in a different plane from the webs, and lies also in a different plane from the tabs 157 when these are bent as illustrated in FIG. 8 to lie snugly within the annular groove 158 formed to receive them. It will thus be seen that when the elongated strip 153 or 154 is formed into a circular configuration to fit the inner periphery of the nose sections 132 and 132' of the terminal members, the angularly disposed web members 161 lie in the relationship illustrated in FIG. 7, each web extending generally in a radial direction and having one longitudinal edge 163 forming tight resilient contact with the inner periphery of the associated bores 139 or 146. The opposite edge 164 of each web is arranged to present an elongated end surface that comes in resilient contact with the associated outer periphery 166 of a centrally disposed movable contact designated generally by the number 167.

The movable contact is preferably fabricated from a solid slug of aluminum to provide a cylindrical body portion 168 having an inner periphery 169 closed by a transverse wall 171. On opposite sides of the wall 171, the movable contact is provided with a nose section 172 adapted to be selectively engaged with the annular insulating ring 142 in the position of the parts illustrated in FIG. 6. The opposite end of the cylindrical movable contact constitutes a bearing section 173 provided on its outer periphery with a quadring 174 to seal the union between the outer periphery 166 and the inner periphery 146 of the terminal member 143.

Figure 6:
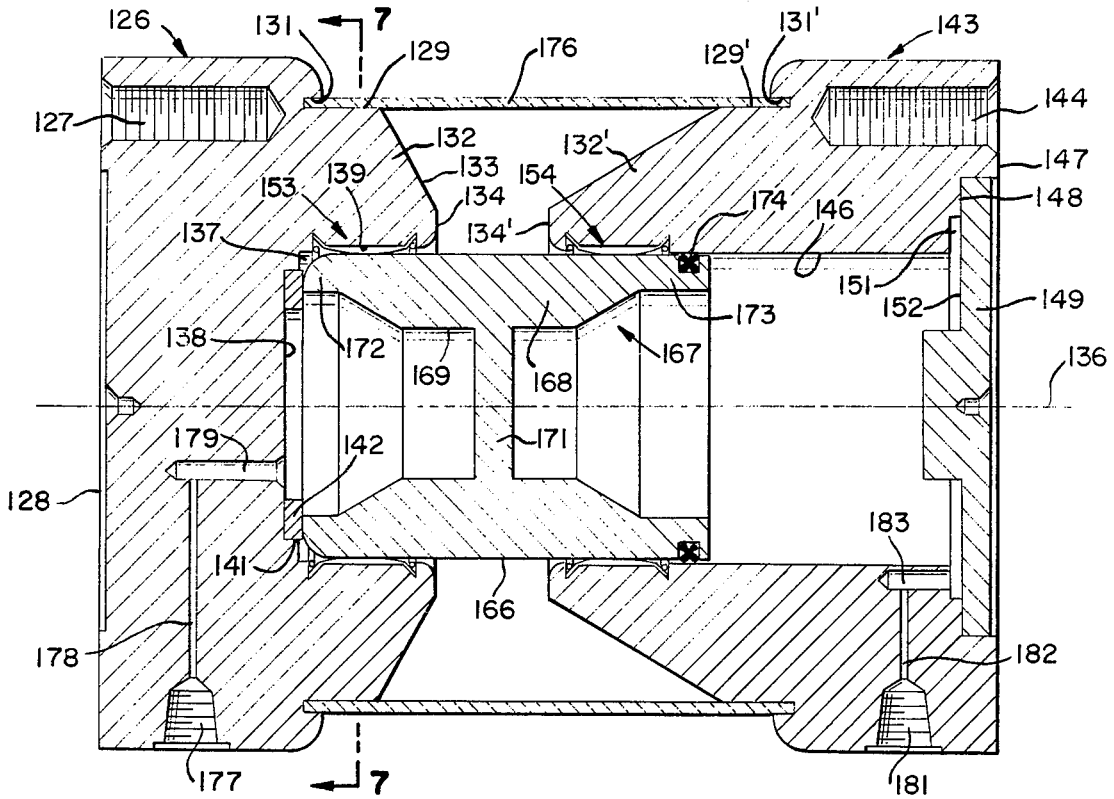
FIG. 6 is a cross-sectional view of a fifth embodiment of the switch illustrating a different contact assembly embodying a pair of resilient fixed contact bands arranged to extend completely around the movable contact when engaged therewith.
Figure 7:
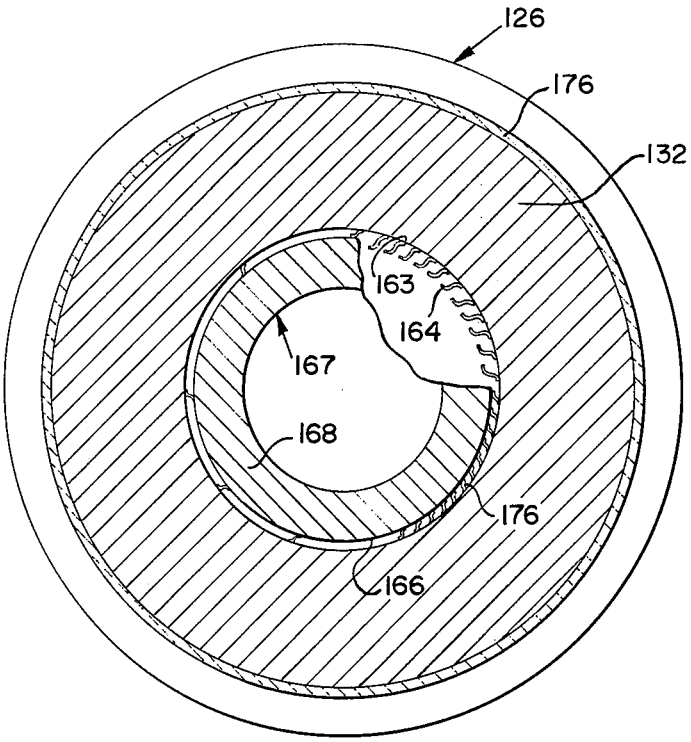
FIG. 7 is a cross-sectional view taken in the plane indicated by the line 7—7 in FIG. 6.

It will thus be seen that in the orientation of the fixed contact members 153 and 154 as illustrated in FIG. 6, the outer surface 166 of the movable contact is preferably smooth and comes into electrically conductive relationship with each of the webs 161 spaced in small increment 360 degrees about the movable contact. The outer diameter of the movable contact that defines the surface 166 is proportioned so that when the movable contact lies disposed in the position illustrated in FIG. 6, the webs 161 are flattened somewhat as illustrated at 176 in FIG. 7. Thus, the inherent resilience of the webs 161 minimize the contact resistence because of the individual pressure each imposes on the outer periphery of the movable contact. Additionally, since the path of current through the switch is from one terminal member, through the movable contact by way of the multiplicity of webs 161 and thence through the movable contact and the opposite set of fixed contacts embodying webs 161 and the terminal member associated therewith, the path that the current must follow is an extremely short one. Additionally, it will be seen that since the contact strip 156 is arranged in a circular array, contact will be made with the movable contact through approximately 160°.

To retain the end terminal members 126 and 143 in axially spaced alignment as illustrated, there is disposed in the recess 131 and 131', and shoulders 129 and 129', a cylinder 176 of epoxy glass. The cylinder may be threaded into the recesses 131, but it has been found that using a suitable epoxy adhesive will secure the glass envelope with sufficient strength to retain the pressures that are imposed on the interior of the envelope.

To actuate the movable contact 167, there is provided in the end terminal 126, a bore 177 to receive an air hose fitting (not shown). The bore 177 is connected by a passageway 178 and 179 with the interior of the envelope, the passage 179 passing through the bottom wall 138 of the terminal member 126.

At the opposite end of the switch, a similar threaded bore 181 is provided, connected by passageways 182 and 183 with the annular passageway 151 disposed between the underside surface 152 of the end plate 149 and the end of bore 146. It will thus be seen that injecting fluid under pressure into either one of the threaded bores 177 or 181 causes the movable piston 167 to move in the opposite direction.

A switch structure fabricated in the proportions indicated in FIG. 6, which is shown essentially in full scale, it has been found that with the end terminal members 126 and 143 silver plated as previously discussed, and with the fixed contact assemblies 153 and 154 also silver plated, and with the surfaces of the movable contact 167 silver plated, the switch structure illustrated may easily carry six thousand amps of direct current, or may be utilized in a radial frequency application without appreciable heating. It has been found that air pressure may vary from thirty to seventy pounds per square inch may be utilized to shift the piston, the wide range of air pressures eliminating any criticality in this area. To regulate the transfer time of the piston from one end of the switch to the other, all that is required is that the bleed passageways 178 and 182 be proportioned to provide the requisite transfer time. Thus, a larger bore will provide a faster time, whereas a smaller bore slows the transfer time.

It is an advantage that all of the current passing between the terminal members 126 and 143 pass through the silver plated copper movable contact 167. To effect this purpose, the impact ring 142 is rendered electrically insulative by anodizing the surface thereof as previously stated. Additionally, the end plate 149 is also formed from aluminum that has been heavily anodized to render the end plate non-conductive. It will thus be seen that when the movable contact is in the switch open position as illustrated, current passing between each of the terminal members and the associated movable contact passes in parallel through the multiplicity of resilient web members 161 which individually impinge resiliently on the bore 139 on the one hand and the associated end portion 172 of the movable contact on the other hand when the switch is in "OPEN" position. Obviously, the fixed contact assembly 154 operates by the same mode, and performs the additional function of providing a bearing support for the movable contact 167 when the movable contact is moved to the right into a switch "CLOSED" position. It has been found that best results are secured from the fixed contact assembly when the multiple contact strip 156 is fabricated from beryllium copper and silver plated in conformity with the rest of the structure.

Having thus described the invention, what is claimed to be novel and sought to be protected by letters patent is as follows:

I claim:

1. An electric switch structure comprising:

a. a pair of axially aligned and spaced terminal connection members having fixed cylindrical contact surfaces thereon arranged in axially spaced relationship;

b. a cylindrical dielectric sleeve disposed between said spaced terminal connection members, the inner peripheral surface of said sleeve being coextensive with the inner peripheral surface of said fixed cylindrical contact surfaces on said terminal connection members;

c. a movable contact disposed within the envelope formed by said terminal connection members and said dielectric sleeve and reciprocable between first and second positions to make or break an electric circuit through said terminal connection members, said movable contact including a pair of oppositely extending cylindrical skirt portions, each skirt portion comprising a multiplicity of resilient contact fingers arranged in a circular array and guided in its movement by the interior periphery of said fixed contact surfaces and said intermediate dielectric sleeve; and d. said movable contact constituting an electrically conductive piston which makes electrical contact with said spaced terminal connection members through substantially 360°

2. The combination according to claim 1, in which said terminal connection members constitute hollow electrically conductive shells axially aligned with said intermediate dielectric sleeve to form an axially extending slideway through which said movable contact moves between said first and second positions, said movable contact in said first position spanning the space between said hollow electrically conductive shells to form a direct connection therebetween.

3. The combination according to claim 1, in which one of said terminal connection members includes a second cylindrical dielectric sleeve coaxially disposed therewithin, the inner peripheral surface of said second dielectric sleeve and being coextensive to the contact surfaces of said fixed contacts forming a part of said terminal connection members.

4. The combination according to claim 1, in which thermally conductive stop means are associated with each of said terminal connection members cooperating with said movable contact member to restrict movement thereof between said first and second positions.

5. The combination according to claim 1, in which the inner peripheral surfaces of said terminal connection members forming fixed contact surfaces are cylindrical in configuration, the inner peripheral surfaces of said intermediate dielectric sleeve is cylindrical and coextensive with the cylindrical contact surface of said fixed contacts, and said movable contact makes contact with said fixed contact through sliding action thereof along the inner periperal surfaces thereof without flexure of said movable contact.

6. The combination according to claim 1, in which each of said terminal connection members is cylindrical in configuration having a cylindrical bore extending therethrough, said fixed cylndrical contact surfaces being associated with the associated ends of said terminal connection members, and end cap means sealing the central cylindrical bore of each said terminal connection member at the end thereof remote from said fixed contact surface.

7. The combination according to claim 1, in which a dielectric sleeve is disposed between said terminal connection members in circumscribing coaxial relationsip with said first mentioned dielectric sleeve.

8. The combination accorded to claim 1, in which the interior of said terminal connection members constitute fluid tight chambers, and means are provided connecting said chambers with a source of fluid pressure, said movable contact constituting a piston within the envelope against which said fluid pressure may work.

9. The combination accorded to claim 1, in which said movable contact is adapted to reciprocate between said first and second positions, seal means are provided associated with said movable contact and disposed intermediate the ends thereof and providing a fluid tight yet slidable connection between said contact and the inner periperal surfaces of said fixed contacts and the inner peripheral surfaces of said dielectric sleeve, whereby fluid under pressure may be selectively admitted to the interior of said hollow terminal connection members on opposite sides of said movable contact to effect movement thereof in a selected direction.

10. The combination accorded to claim 1, in which a second dielectric sleeve is disposed coaxially about the first mentioned dielectric sleeve, and means are provided filling the space between said dielectric sleeves and said fixed contact surfaces to increase the voltage breakdown limit between associated ends of said terminal connection members.

11. An electric switch comprising:

a. a hollow envelope structure generally symmetrically arranged about a longitudinal axis and including an elongated tubular slideway within the envelope coaxially disposed about the longitudinal axis and including electrically conductive and non-conductive sections spaced apart so that said conductive sections are electrically insulated one from the other by said conductive and non-conductive sections cooperating to form a smooth interior surface in said tubular slideway;

b. terminal means closing opposite ends of said elongated tubular slideway, each of said terminal means being electrically connected to one of said electrically conductive sections of said slideway;

c. movable contact means reciprocally mounted within said slideway and having contact surfaces thereon adapted to selectively span a dielectric section of said slideway to electrically connect adjacent but axially spaced and normally electrically insulated conductive sections of said slideway to selectively make or break a circuit through said switch;

d. said movable contact constituting an electrically conductive piston which makes electrical contact with said spaced electrically conductive sections through substantially 360 degrees; and e. electrically conductive stop means on said movable contact and thermally conductive stop means on said terminal members limiting the extent of movement of said movable contact within said slideway.

12. The combination according to claim 11, in which means are provided associated with said movable contact for sealing the space between said movable contact and the innner periphery of said slideway whereby said movable contact constitutes a piston adapted for longitudinal displacement within said slideway, and means are provided for admitting a fluid under pressure into said slideway on one side or the other of said movable contact to effect reciprocation thereof within said slideway.

13. The combination according to claim 11, in which one of said conductive sections of said slideway constitutes the common contact, and the other of said conductive sections of said slideway constitute terminal contacts, and said movable contact is selectively movable between said common contact and one or the other of said terminal contacts.

14. A switch structure comprising:

a. first, second and third terminal members axially aligned and spaced along a longitudinal axis;

b. fixed contact surfaces formed on said first, second and third terminal members;

c. dielectric sleeve means disposed between said fixed contact surfaces, the said fixed contact surfaces and the inner peripheries of said dielectric sleeves being coextensive to thereby define a cylindrical slideway;

d. a movable contact member reciprocable within said slideway and having contact surfaces thereon spaced apart in correlation to the spacing between said fixed contact surfaces whereby longitudinal displacement of said movable contact from a first position to a second position will effect completion of an electrical circuit between a selected pair of said terminal members;

e. said movable contact constituting an electrically conductive piston which makes electrical contact with said spaced contact surfaces through substantially 360 degrees;

f. one of said terminal members constituting a common terminal and including an intermediate centrally disposed section forming a stop for limiting movement of an associated movable contact; and g. a movable contact on the opposite side of said intermediate terminal operable to selectively complete a circuit between said intermediate terminal member and the associated other terminal member.

15. An electric switch structure comprising:

a. a pair of axially aligned and spaced terminal connection members having fixed resilient circularly arranged contact surfaces thereon arranged in axially spaced relationship;

b. a dielectric sleeve disposed between said spaced terminal connection members to retain them in spaced alignment and to electrically insulate one from the other; and c. a movable contact disposed within the envelope formed by said terminal connection members and said dielectric sleeve and reciprocable between first and second positions to make or break an electric circuit through said terminal connection members;

d. said movable contact constituting an electrically conductive piston having a smooth cylindrical contact surface which makes electrical contact with said circularly arranged spaced terminal connection members through substantially 360°.

16. The combination according to claim 15, in which said fixed resilient circularly arranged contacts comprise an elongated strip of conductive metal sections of which have been sprung out of the plane of the strip to provide a multiplicity of angularly disposed webs therealong, one edge of each web adapted to resiliently impinge against the associated terminal member and the other edge of each web being adapted to resiliently impinge against the smooth cylindrical contact surface of said movable contact when the switch is in "closed" condition whereby said multiplicity of webs provide parallel paths for the passage of electrical current between the movable contact and the associated terminal members.

17. The combination according to claim 16, in which said elongated strip of conductive metal is formed from beryllium copper.

18. The combination according to claim 16, in which said elongated strip of conductive metal is formed into a circular configuration and disposed within each associated terminal member.

19. The combination according to claim 16, in which each said fixed resilient contact is formed into a circular configuration, and a retainer ring is provided to retain the contact strip in conductive contact with each associated terminal member.

20. The combination according to claim 16, in which engagement of the movable contact with said web sections of said strip sprung from the plane of the strip effects resilient displacement of said webs in a direction toward the plane of the strip.

21. The combination according to claim 16, in which the interior surfaces of said terminals, said resilient contact strips and said movable contact are silver plated.

22. The combination according to claim 16, in which electrical insulator means are provided within one of said terminal members against which said movable contact impinges when the switch is in "closed" condition.

23. The combination according to claim 16, in which said movable contact comprises a piston generally tubular in cross-section and having a transverse wall disposed intermediate its ends, and seal means disposed between the outer periphery of the movable contact and one of said terminal members whereby fluid under pressure admitted into said envelope one side or the other of said transverse wall will effect axial translation of the movable contact to make or break a circuit therethrough.

* * * * *